United States Patent [19]

Mino

[11] 4,072,003

[45] Feb. 7, 1978

[54] DOUBLE TWISTING MACHINE OF FLYER TYPE

[75] Inventor: Kazuhiko Mino, Iwakuni, Japan

[73] Assignee: Teijin Seiki Company Limited, Osaka, Japan

[21] Appl. No.: 764,733

[22] Filed: Feb. 1, 1977

[30] Foreign Application Priority Data

July 19, 1976 Japan ..... 51-95971

[51] Int. Cl.[2] ..... D01H 7/86; D01H 7/24

[52] U.S. Cl. ..... 57/58.52; 57/115

[58] Field of Search ..... 57/58.52, 58.54, 58.63, 57/64, 67–71, 115–118, 58.61, 58.68

[56] References Cited

U.S. PATENT DOCUMENTS

| | | | |
|---|---|---|---|
| 2,464,860 | 3/1949 | Green | 57/58.52 |
| 2,773,344 | 12/1956 | Van Hook | 57/58.52 |
| 3,624,993 | 12/1971 | Van Hook | 57/58.52 |

OTHER PUBLICATIONS

Moss, "Quick Connectable Flyer Bow for a Wire Twisting Machine"; Western Electric Technical Digest No. 8, Oct. 1967, pp. 19 & 20.

*Primary Examiner*—John Petrakes

*Attorney, Agent, or Firm*—Haseltine, Lake & Waters

[57] ABSTRACT

Herein disclosed is a double twisting machine of flyer type, which comprises a pair of rotatable fliers, a pair of bow guides formed with a through bore for allowing wire elements to pass therethrough, two pairs of guide holders each retained in one end of each of the fliers for holding one end of each of the bow guides, and two pairs of shock-absorbing elastic members each interposed between each of the fliers and each of the bow guides through the corresponding one of the guide holders. The fliers are in spherical contact with the guide holders so as to assure smooth swinging motions of the bow guides.

5 Claims, 3 Drawing Figures

DOUBLE TWISTING MACHINE OF FLYER TYPE

The present invention relates to a double twisting machine, and more particularly to a double twisting machine of the flyer type, in which a pair of fliers are turned about a stationary shaft to revolve wire elements along a path of travel so as to produce a double twisted wire cord.

In a double twisting machine, generally speaking, there are provided a pair of bow-shaped guides which are operative to allow wire elements to pass therethrough so as to prevent the wire elements from being rotated along an excessively bulged path of travel due to the centrifugal force. Since it is a conventional practice to form those bow guides by bending a pipe having a circular cross-section, it has been impossible to correctly follow the desired shape because of the spring-back action. In the twisting operation at a high speed of revolution, therefore, a concentration of stress is built up due to the resultant large centrifugal force in the end portions of the bow guides, which are supported by the fliers, with the resultant disadvantage that a breakage takes place at those end portions. This invites another disadvantage that it is quite dangerous to operate the double twisting machine having such bow guides and that it becomes necessary to replace the bow guides so frequently as to reduce the efficiency. Since, moreover, the bow guides revolve at a high speed, they will establish high vibrations and noises, with the resultant disadvantage that the working atmosphere is materially deteriorated.

It is, therefore, a major object of the present invention to provide a double twisting machine of the flyer type, in which the afore-mentioned disadvantages concomitant with the prior art are eliminated.

Another object of the present invention is to provide a double twisting machine of the above type, in which the fliers are in spherical contact with the guide holders so as to assure smooth swinging motions of the bow guides.

According to a major aspect of the present invention, there is provided a double twisting machine which comprises a pair of rotatable fliers, a pair of bow guides formed with a through bore for allowing wire elements to pass therethrough, two pairs of guide holders each retained in one end of the fliers for holding one end of each of the bow guides, and two pairs of elastic shock-aborbing members each interposed between each of the fliers and each of the bow guides through each of the guide holers, the flyers being in spherical contact with the guide holders so as to assure smooth swinging motions of the bow guides.

Other objects and advantages of the present invention will become apparent from the following description taken in conjunction with the accompanying drawing, in which.

Figure 1:
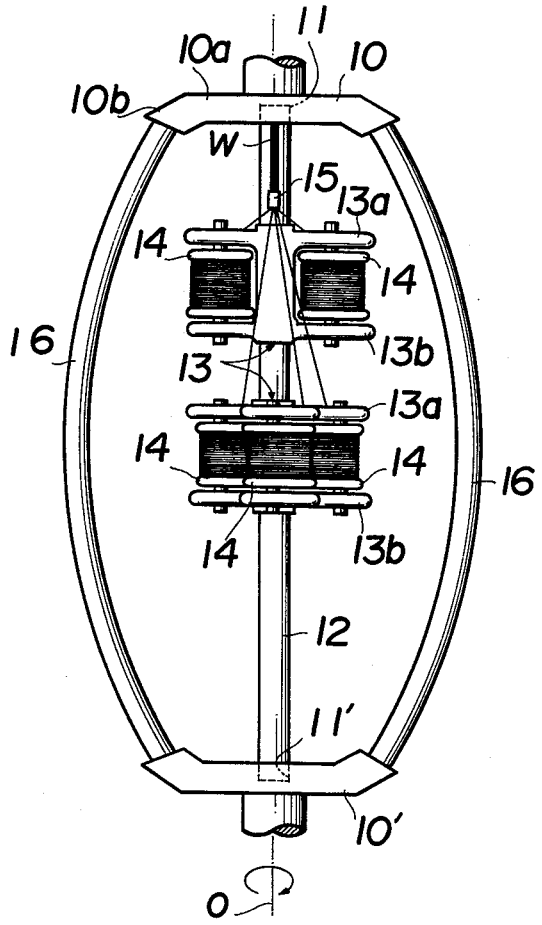
FIG. 1 is a diagrammatical front elevation showing a double twisting machine, in which the joint between the flyer and the bow guide is improved according to the invention.

Reference will now be made to the accompanying drawing, in which like reference numerals indicate the like parts or elements. Indicated at reference numerals 10 and 10' are a pair of fliers which are rotatably supported at a predetermined spacing inbetween upon the frame of a not-shown double twisting machine and which are driven for rotation about an axis 0 of revolution by the action of a not-shown drive mechanism. These fliers 10 and 10' are formed at the centers of their facing surfaces with holes 11 and 11', in which the both ends of a stationary shaft 12 are inserted and supported for rotation. This stationary shaft 12 is afforded with such a large inertia that it can remain stationary even when the fliers 10 and 10' are revolving thereabout. Indicated at numeral 13 are two brackets which are secured to a middle portion of the stationary shaft 12. Each of these brackets 13 is equiped with support portions **13*a* and 13*b* which are spaced at a predetermined spacing from each other and which are made to extend radially outwardly. Indicated at numeral 14 are a plurality of supply reels, each of which has its one end rotatably supported on the support portion 13*a* and its other rotatably supported on the support portion 13*b*. Wire elements W are wound respectively on the supply reels 14 so that they may be drawn therefrom for the subsequent double twisting operation. Indicated at numeral 15 is a guide member which is attached to the stationary shaft 12 downstream of the brackets 13 so as to gather together and guide therethrough the wire elements W drawn from their respective supply reels 14. Moreover, indicated at numeral 16 are a pair of bow-shaped hollow guides, each of which has its both ends supported by the fliers 10 and 10' and which is formed with a through bore 17 for allowing the wire elements W drawn from the supply reels 14** to pass therethrough.

Figure 2:
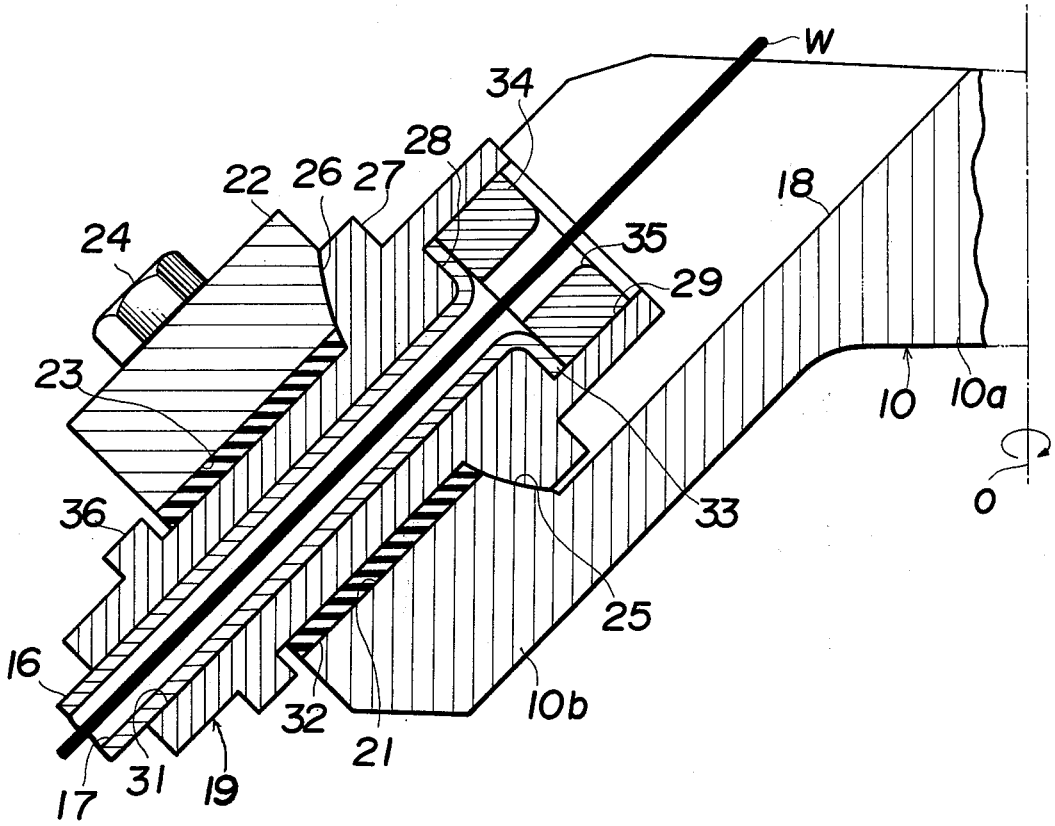
FIG. 2 is a partially enlarged section showing the joint between the flyer and the bow guide according to the invention and FIG. 3 is a cross-sectional view similr to FIG. 2 but showing another embodiment of the present invention.

As better shown in FIG. 2, the flyer 10 (or the flyer 10') is composed of a rectangulr portion **10*a*, whose center of gravity is located in line with the axis 0 of revolution, and of two inclined hollow portions 10*b*, each of which is made to extend at a predetermined angle of inclination from the radially outermost end of the rectangular position 10*a*. In an outer portion of the inclined portion 10*b* adjacent to the rectangular portion 10*a*, there is formed an insert groove 18, which is formed to have a U-shaped cross-section so as to easily admit one of bow guide holders 19. In an outer portion of the inclined portion 10*b* adjacent to the radially outermost end of the same, there is formed a semicircular holding groove 21 which is formed to have a semicircular cross-section and which has its one end merging into the insert groove and the other merging into the radially outermost end of the inclined portion 10*b*. Indicated at numeral 22 is a holding member which is formed with a semicircular holding groove 23 of a semicircular cross-section similar to that of the holding groove 21 and which can be fastened to the remaining portion of the inclined portion 10*b* by means of a bolt 24 or the like. Then, a circular bore is formed between the two holding grooves 21 and 23. Spherically concave seat surfaces 25 and 26 are formed both at a shoulder portion between the insert groove 18 and the holding groove 21 and at the radially innermost end of the holding member 22, so as to provide a spherically concave seat at the rear end of the circular bore 21 and 23. It should be noted that the bow guide holder 19 is formed at its rear end with a flange 27 which is formed at its front end with a spherically convex surface of such a curvature as can be smoothly fitted in the concave seat 25 and 26. As a result, the front convex surface of the flange 27 of the guide holder 19 can be in spherical contact with the flyer 10 at the concave seat 25 and 26 of its inclined portion 10***b*. The bow guide holder 19 is formed with a through bore which is divided at an intermediate shoulder portion 28 into a ring bore 29 and a bow guide bore 31. The ring bore 29 is located at the rear end of the guide holder 19 and is opened into the insert groove 18. On the other hand, the guide bore 31 has a smaller diameter than the ring bore 29 and has its one end merging into the ring bore 29 and the other opened toward the front end face of the guide holder 19. A shock-absorbing rubber element 32 of split cylindrical shape is interposed between the outer circumference of an intermediate portion of the bow guide holder 19 and the inner circumference of the bore, which is formed by the holding grooves 21 and 23 of the inclined portion 10*b* and the holding member 22, so that the vibrations of the bow guide holder 19, if any, may be absorbed. Each of the bow guides 16 is formed at its respective ends with a flange 33 which is made to extend radially outwardly but the diameter of which is slightly smaller than that of the ring bore 29. The bow guide 16 thus fabricated is inserted into the guide bore 31 of the guide holder 19 and is retained thereby at their flanges 33. Indicated at numeral 34 is a retaining ring 34 which is formed with a bore 35 and which has the same outer diameter as the diameter of the ring bore 29. The retaining ring 34 thus prepared is inserted by the shrinkage fit into the ring bore 29 so as to retain in position the flange 33 of the bow guide 16 together with the shoulder portion 28.

The operations of the present invention will now be described in the following. First of all, the supply reels 14, which are wound fully with their wire elements W, are attached to the brackets 13. Then, the leading ends of the wire elements W are taken out of the respective reels 14 and are taken up by a not-shown take-up mechanism by way of the guide member 15 and the through bores 17 in the bow guides 16. When this preparation is finished, the not-shown drive mechanism is driven to revolve the fliers 10 and 10'. As a result, the wire elements W are twisted once at the flyer 10 and twice at the flyer 10' so as to produce a double twisted wire cord. In this meanwhile, the stationary shaft 12, the brackets 13 and the supply reels 14 can remain stationary or can be kept due to their own inertia from revolving about the axis 0. Then, the fliers 10 and 10' are turned at an increased speed so as to accomplish the high speed twisting operation. It should be accepted here that the discussion will be limited to the flyer 10 for simplicity only. As the speed of revolutions of the flyer 10 increases, the centrifugal force to be exerted upon the bow guide 16 increases accordingly. As a result, the bow guide 16 is subjected to elastic deformation by the action of the centrifugal force. In this instance, the angle of inclination of the bow guide holder 19 is determined at a point where there is established a stable balance between the centrifugal force and the elastic force. Since, moreover, the front end face of the flange of the guide holder 19 is in spherical contact with the spherical concave seat 25 and 26 of the flyer 10 and the holding member 22, the guide holder 19 can accomplish its swinging motions smoothly in accordance with the motions of the bow guide 16 so that the stress may be prevented from being concentrated at the leading end of the guide holder 19. It should be noted that the angle of the swinging motions is not so large as to break the shock-absorbing rubber element 32. It should also be noted that any vibrations, which are established due to the friction between the bow guide 16 and the surrounding air, can be transmitted through the guide holder 19 and absorbed by the rubber element 32. Incidentally, indicated at numeral 36 is an annular stopper which may be made integral with the guide holder 19 in a position close to the front end of the same so as to prevent the same from moving longitudinally to an excessive extent.

Figure 3:
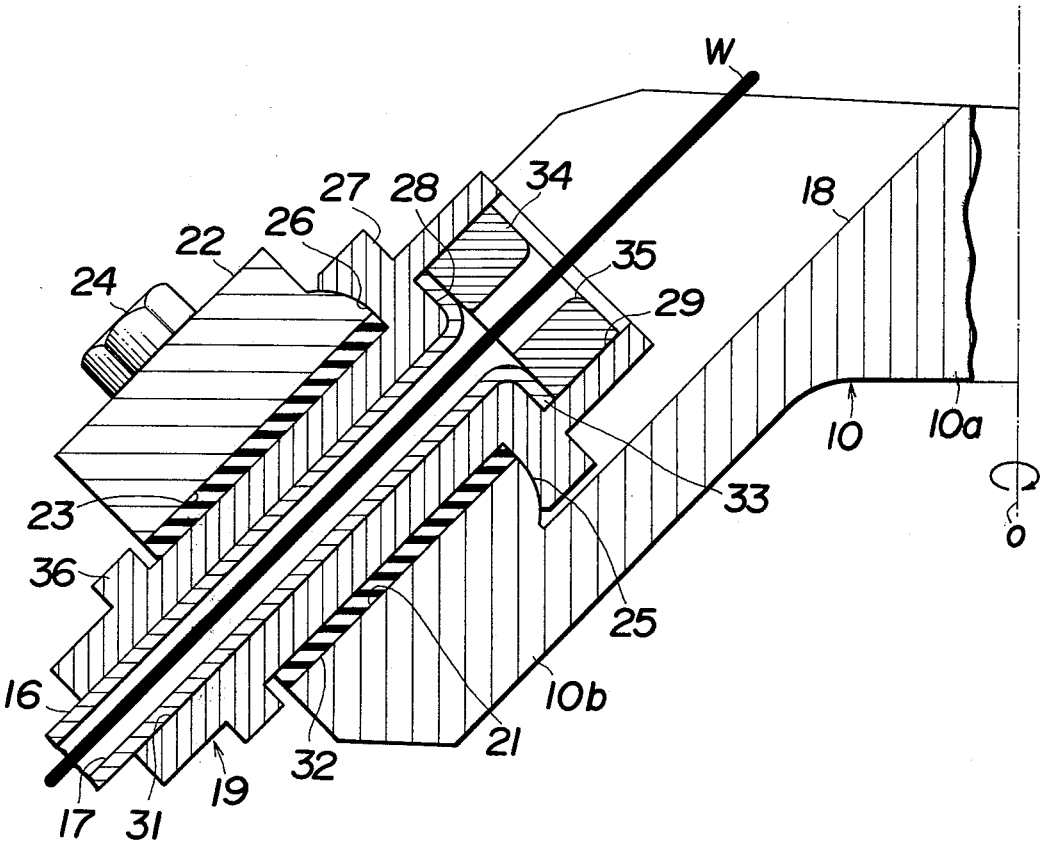

Although the discussion has been made to the case where the shock-absorbing rubber element 32 of split cylindrical shape is used, in the aforegoing embodiment, as an elastic element to be interposed between the flyer and the bow guide, the rubber element 32 may desirably be replaced by a hard rubber element of cylindrical shape, which is formed at its rear end with such a flange as has a spherically convex front end surface. In the foregoing embodiment, moreover, the discussion has also been made to the case where the front end of the flange 27 is formed into a spherically convex surface while the spherical seat 25 and 26 at the rear end of the bore formed by the inclined portion 10*b* and the holding member 22 is made concave. In an alternative, however, it is possible that the front end of the flange 27 has a concave shape while the spherical seat 25 and 26 has a convex shape as shown in FIG. 3.

As has been described hereinbefore, the concentration of stress at the both end portions of the bow guides can be obviated according to the present invention by the automatic centripetal action resulting from the spherical contact between the flyers and the bow guide holders. Thus, it should be appreciated as an advantage of the present invention that the breakage of the end portions of the bow guides can be prevented with the resultant remarkable rise in safety and accordingly that the replacement of the bow guides can be avoided with the resultant increase in efficiency. It should also be appreciated as another advantage that, since the vibrations are absorbed by an elastic element, the undesired vibrations and noises can be remarkably reduced with the resultant improvement in the working atmosphere.

What is claimed is:

1. A double twisting machine comprising a pair of rotatable fliers, a pair of bow guides formed with a through bore for allowing wire elements to pass therethrough, two pair of guide holders each retained in one end of each of said fliers for holding one end of each of said bow guides, and two pair of shock-absorbing elastic members each interposed between each of said fliers and each of said bow guides through the corresponding one of said guide holders, said guide holders being universally movably connected at an extreme end of each of said elastic members with said fliers to assure smooth swinging motions of said bow guides.

2. A double twisting machine according to claim 1, wherein each of said fliers has two inclined hollow portions each formed both with a bore, in which the corresponding one of said guide holders is retained through the corresponding one of said elastic members, and with a spherical seat which is positioned at the rear end of said bore, and wherein each of said guide holders is formed at its rear end with a flange which is formed at its front end with a spherical surface of such a curvature as can be smoothly fitted in the spherical seat of the corresponding one of said fliers.

3. A double twisting machine according to claim 2, wherein said spherical seat is made concave while the spherical surface of said flange is made convex.

4. A double twisting machine according to claim 2, wherein said spherical seat is made convex while the spherical surface of said flange is made concave.

5. A double twisting machine according to claim 2, wherein each of the inclined hollow portions of said fliers includes a separate holding member which can be fastened to the remaining portion of the corresponding one of said hollow portions so as to fix in position and remove the corresponding one of said guide holders together with the corresponding one of said bow guides.

* * * * *